US007077627B2

(12) United States Patent
Kupferberg

(10) Patent No.: US 7,077,627 B2
(45) Date of Patent: Jul. 18, 2006

(54) FAN ASSEMBLY AND METHOD

(76) Inventor: Minel Kupferberg, 5862 Ferncroft, Hampstead, Québec (CA) H3X 1C7

( * ) Notice: Subject to any disclaimer, the term of this patent is extended or adjusted under 35 U.S.C. 154(b) by 88 days.

(21) Appl. No.: 10/918,383

(22) Filed: Aug. 16, 2004

(65) Prior Publication Data

US 2006/0034681 A1 Feb. 16, 2006

(51) Int. Cl.
*F03D 11/00* (2006.01)

(52) U.S. Cl. ..... 415/201; 417/361; 417/423.15

(58) Field of Classification Search ..... 415/132, 415/140, 201; 417/359, 360, 361, 363, 423.15
See application file for complete search history.

(56) References Cited

U.S. PATENT DOCUMENTS

| | | | |
|---|---|---|---|
| 2,464,473 | A | 3/1949 | Wessel |
| 2,711,285 | A | 6/1955 | Burrowes |
| 3,425,621 | A | 2/1969 | Greenheck |
| 4,092,088 | A | 5/1978 | Nemesi |
| 4,130,376 | A | 12/1978 | Dietsche |
| 5,100,302 | A | 3/1992 | Ceccherini |
| 5,185,941 | A | 2/1993 | Dongelmans |
| 5,439,349 | A | 8/1995 | Kupferberg |
| 5,613,843 | A | 3/1997 | Tsusu et al. |

FOREIGN PATENT DOCUMENTS

| | | | |
|---|---|---|---|
| JP | 01320397 | A * | 12/1989 |
| JP | 02168098 | A * | 6/1990 |

* cited by examiner

*Primary Examiner*—Edward K. Look
*Assistant Examiner*—Dwayne J White
(74) *Attorney, Agent, or Firm*—Ogilvy Renault LLP

(57) ABSTRACT

A fan assembly comprising a casing having an inlet and an outlet for fluid circulation through the casing, and a closeable opening to allow access to an interior of the casing. A rotor induces fluid circulation in the casing. A motor is connected to the rotor so as to actuate the rotor. A carriage supports the motor and the rotor, the carriage being operatively mounted to a track so as to be displaceable between an operating position of the fan assembly, in which the rotor is positioned in the casing for inducing fluid circulation in the casing, and a maintenance position of the fan assembly, in which the rotor is out of the casing for maintenance, wherein the rotor is displaced between the operating position and the maintenance position through the closeable opening.

16 Claims, 4 Drawing Sheets

FAN ASSEMBLY AND METHOD

BACKGROUND OF THE INVENTION

1. Field of the Invention

The invention herein disclosed relates to supports for rotors and motors in fan assemblies, and configurations thereof allowing access to the different parts of the assemblies in order to perform maintenance operations.

2. Background Art

Assemblies that couple motors and fans are generally used in the industrial field, mainly in devices such as agitators, blowers, impellers or turbines. These devices have in common the characteristics of mixing, separating or simply controlling the flow of a fluid through a confined space. Depending on the nature of the fluids circulating through the fans blades, the assemblies will be designed in order to provide maximum efficiency and to facilitate maintenance.

Several designs among those encountered in the art have aimed at providing an ergonomic embodiment for fan and motor assemblies, allowing an easy access to their components, mainly the fan, the motor and the casing thereof, for facilitating maintenance.

One such design is described in U.S. Pat. No. 4,092,088, issued to Nemesi on May 30, 1978. It discloses a centrifugal fan and motor assembly housed in a casing intended to be coupled into a ducting network. The fan and motor assembly is attached to a removable door; the latter is bolted to the casing. When the fan and motor assembly is unbolted from the casing, it can either remain attached to the casing, resting on the lower cutting edge of the opening thereof, or be completely removed from the casing. This latter operation is carried out by lifting the assembly in order to disengage it from the casing, then pulling the assembly out of the casing. This configuration involves mechanical lifting equipment (e.g., a crane) or specific manpower, thus making this fan assembly inefficient.

U.S. Pat. No. 5,185,941, issued to Dongelmans on Feb. 16, 1998, describes a blower-cleanout door assembly. The assembly, consisting of a blower wheel and a motor, is mounted on a swing-out door. The door panel is equipped with a support that carries the blower assembly. When the door is closed, the assembly is operational, and when the door is swung open, it is possible to perform maintenance operations on the blower wheel or on the motor. The blower assembly of this reference is generally designed to provide an easy access to the blower wheel in order to facilitate the cleaning of both the blower wheel and the blower interior.

In this assembly, the door is pivotally mounted on the blower housing such that all the weight of the assembly rests upon two hinges located on each side of the door panel.

This design is therefore unfavourable to heavy assemblies because the hinge bars may crack or break over time, or if the loads applied upon them exceed their mechanical resistance. Moreover, the fluid circulating through the blower housing may corrode the hinge mechanism, especially if the fluid is humid or contains a corroding gas or liquid. These factors reduce the efficiency of such pivotally mounted structures and only allow a certain range of weight that can be sustained by the pivotally mounted door.

It is pointed out that the assemblies of the above-cited references may be subject to failure or extended periods of downtime due to the above-described reasons. Such fan assemblies are often associated with industrial processes whose productivity is affected by the downtime of the fan assembly.

It would be highly desirable to provide a fan assembly that allows maintenance operations to be performed safely, quickly and at low costs. Since the weight of the assemblies encountered in the art can vary from light to very heavy, there is a need for support assemblies that do not impede the efficiency of maintenance operations.

SUMMARY OF THE INVENTION

One aim of the present invention is to provide a novel support system for a motor and rotor of a fan assembly.

It is a further aim of the present invention that the support system facilitate access to an interior of the fan assembly for maintenance.

It is a still further aim of the present invention to provide a novel fan assembly.

Therefore, in accordance with the present invention, there is provided a fan assembly comprising a casing having an inlet and an outlet for fluid circulation through the casing, and a closeable opening to allow access to an interior of the casing; a rotor to induce fluid circulation in the casing; a motor connected to the rotor so as to actuate the rotor; a track; and a carriage supporting the motor and the rotor, the carriage being operatively mounted to the track so as to be displaceable between an operating position of the fan assembly, in which the rotor is positioned in the casing for inducing fluid circulation in the casing, and a maintenance position of the fan assembly, in which the rotor is out of the casing for maintenance; wherein the rotor is displaced between the operating position and the maintenance position through the closeable opening.

Further in accordance with the present invention, there is provided a system for supporting a motor and rotor of a fan assembly, comprising a track adapted to be positioned adjacent to a closeable opening in a casing of the fan assembly; and a carriage adapted to support the motor and the rotor, the carriage being operatively mounted to the track so as to be displaceable between an operating position of the fan assembly, in which the rotor is in the casing so as to induce fluid circulation in the casing, and a maintenance position of the fan assembly, in which the rotor is out of the casing to allow access to an interior of the casing through the closeable opening, the rotor passing through the closeable opening when the carriage is displaced between the operating position and the maintenance position.

BRIEF DESCRIPTION OF THE DRAWINGS

Having thus generally described the nature of the invention, reference will now be made to the accompanying drawings, showing by way of illustration, a preferred embodiment thereof, and in which.

It will be noted that, throughout the appended drawings, like features are identified by like reference numerals.

DESCRIPTION OF THE PREFERRED EMBODIMENT

Figure 1:
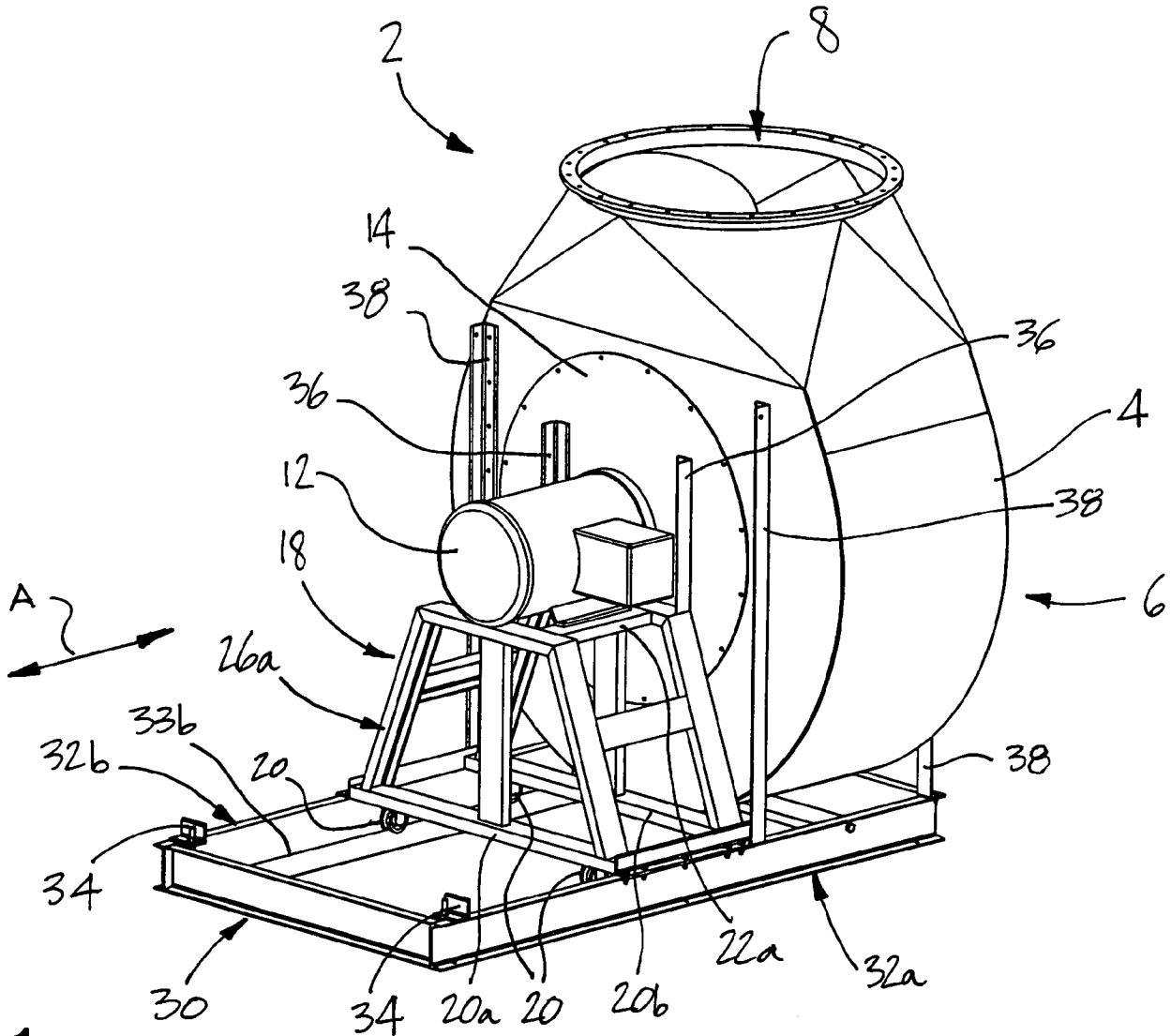
FIG. 1 is a perspective view of a fan assembly in accordance with a preferred embodiment of the present invention, in an operating position, the fan assembly having an upwardly positioned outlet.

Referring first to FIG. 1, in accordance with a preferred embodiment of the present invention, a fan assembly is shown at 2. The fan assembly 2 has a casing 4 having a front inlet 6 and a top outlet 8. The casing 4 encloses a rotor 10 (FIG. 3) (e.g., impeller, fan). The rotor 10 is actuated by a motor 12 that is located on the outer surface of the casing 4 at the rear end thereof, so as to induce fluid circulation in the casing 4, from the inlet 6 to the outlet 8.

A wall portion 14 is removably mounted to the casing 4. The removable wall portion 14 covers an opening in the casing 4 that is sized so as to allow the rotor 10 to pass through the opening. The wall portion 14 closes the opening in the casing 4, as shown in FIG. 1, by being releasably secured to the casing 4 by fasteners such as screws, bolts or the like. It is also contemplated to provide clamps or such mechanisms to keep the wall portion 14 in a secured position onto the casing 4.

The rotor 10 and motor 12 are on opposite sides of the wall portion 14, whereby a hole 16 (FIG. 2) is provided in the removable wall portion 14 so as to define a passage for the motor shaft to transmit the driving force to the rotor 10.

The removable wall portion 14 is secured to and supported by a carriage 18. The carriage 18 also consists of a support structure for the rotor 10 and the motor 12. The carriage 18 is mounted onto rails 32*a* and 32*b* of a structure 30, whereby the rotor 10 may be moved in and out of the casing 4, as illustrated by direction A. This movement is allowed by wheels 20 located at a bottom of the carriage 18. Although the fan assembly 2 has wheels 20 on the carriage 18, other mechanisms such as rollers, casters, skids, gears/pinions may be used to allow translation between the carriage 18 and the structure 30.

The carriage 18 has a trapezoid shape and is provided with horizontal members such as 20*a*, 20*b*, 22*a* and 22*b*, and vertical members such as 24*a*, 24*b*, 26*a* and 26*b*, so as to provide the carriage 18 with structural integrity in supporting the rotor 10, motor 12 and wall portion 14.

Figure 2:
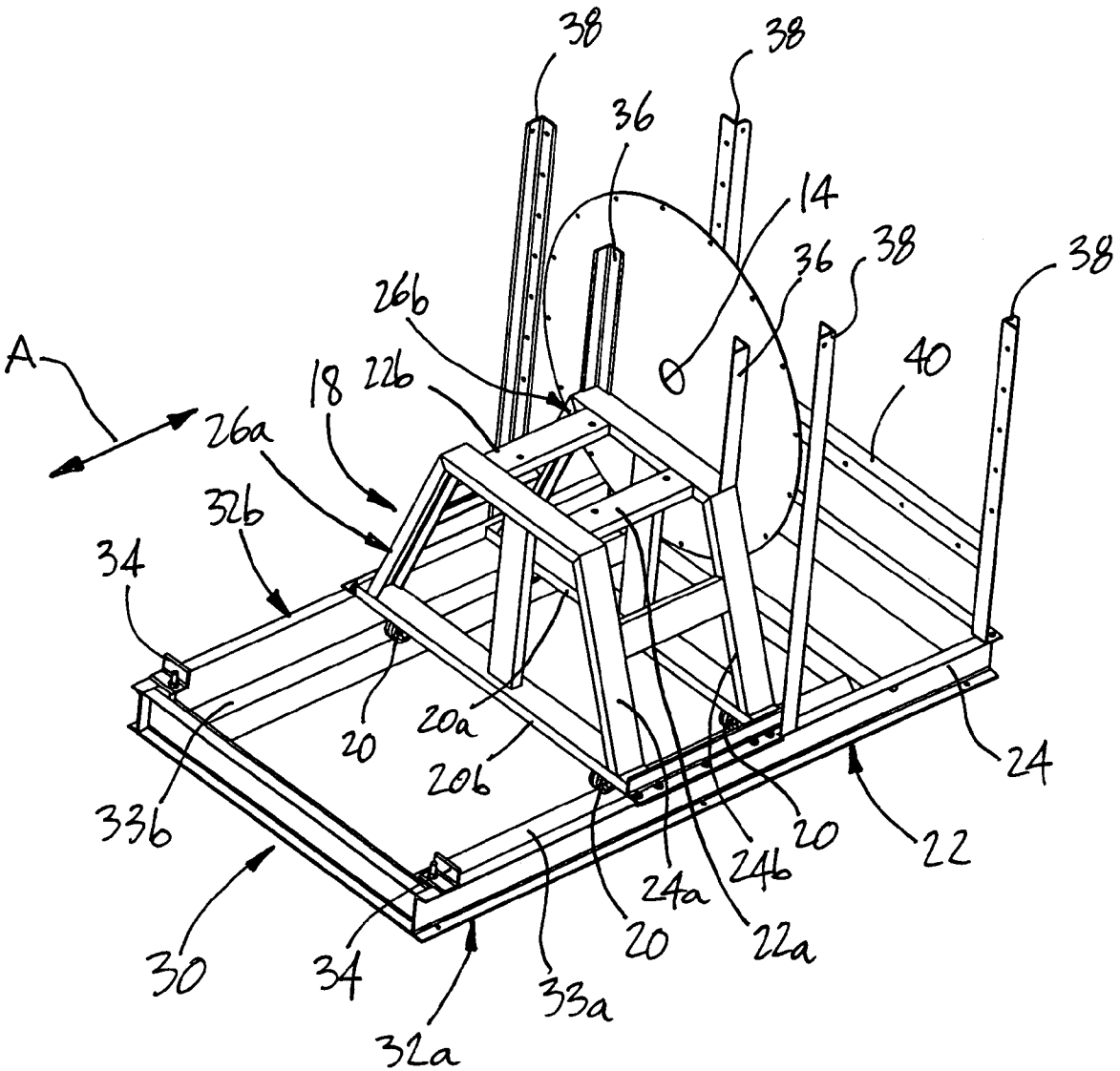
FIG. 2 is a perspective view of the support system of the fan assembly, having a carriage on tracks.

Referring to FIG. 2, the support 30 upon which is mounted the carriage 18 is shown in greater detail. For simplicity purposes, the carriage 18 is shown in FIG. 2 without the rotor 10 and the motor 12. The support 30 has a pair of parallel beam members 32*a* and 32*b*. The beam members 32*a* and 32*b* form tracks 33*a* and 33*b*, respectively, upon which the carriage 18 is displaceably mounted so as to be displaced along direction A. Stops 34 are provided at an end of the beam members 32*a* and 32*b* so as to limit the displacement of the carriage 18 away from the casing 4. In the illustrated embodiment, the abutments 34 consist of L-shaped pieces, which are releasably secured to the beam members 32*a* and 32*b*, whereby their position on the beam members 32*a* and 32*b* may be adjusted.

The carriage 18 has a pair of upstanding posts 36, to which the wall portion 14 is secured. Accordingly, the wall portion 14, in the illustrated embodiment, is displaceable with the carriage 18. It is contemplated to provide an alternative to the removable wall portion 14 displaceable with the carriage 18. For instance, doors (e.g., sliding gates, pivoting doors, or the like) may be provided onto the casing 4, so as to cover the closeable opening through which the rotor 10 (FIG. 3) will exit the casing 4.

It is contemplated to provide the fan assembly 2 as a whole, namely assembled as shown in FIG. 1, for subsequently being installed into operating position. Accordingly, as shown in FIG. 2, the structure 30 has four upstanding posts 38 to support the casing 4. Addition supporting members, such as transverse beam 40, may be provided to strengthen the structural relation between the casing 4 and the structure 30.

Figure 3:
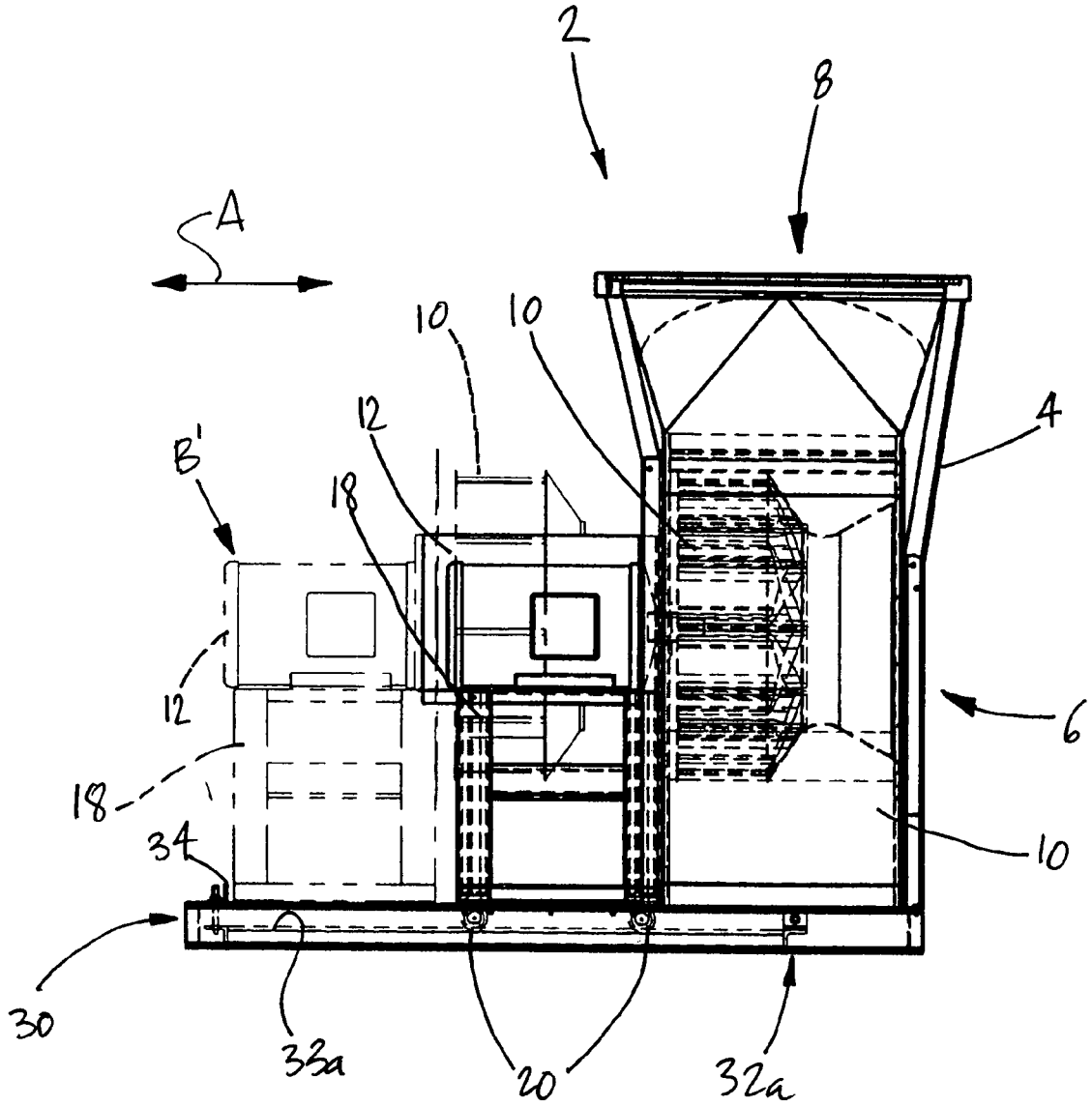
FIG. 3 is a side elevation view, partly sectioned, of the fan assembly, illustrating the operating position and the maintenance position.

Now that the fan assembly 2 has been described, the method by which the interior of the casing 4 is accessed follows with reference to FIGS. 1 and 3. In FIG. 1, the fan assembly is in its operating configuration, with the carriage 18 being in an operating position of the fan assembly 2 that has the rotor 10 within the casing 4 (as seen in FIG. 3), so as to induce fluid circulation in the casing 4. The wall portion 14 is secured to the casing 4, so as to cover an opening in the casing 4.

To withdraw the rotor 10 from the casing 4, the fan assembly 2 must not be operating (i.e., the power supply to the fan assembly 2 is switched off). The wall portion 14 is disengaged from the casing 4. In the illustrated embodiment of FIG. 1, the fasteners are removed, whereby the wall portion 14 may be separated from the casing 4. The carriage 18, supporting the rotor 10, the motor 12 and the wall portion 14, is pulled away from the casing 4 by translating on the tracks 33*a* and 33*b*, whereby the rotor 10 exits the casing 4. The abutments 34 end the translation of the carriage 18 away from the casing 4, at which point the carriage 18 is in the maintenance position of the fan assembly 2. In FIG. 3, the maintenance position of the fan assembly 2 is shown in broken lines at B'. In the maintenance position of the fan assembly 2, the interior of the casing 4 may be accessed by the closeable opening through which the rotor 10 exited the casing 4. Moreover, the rotor 10 is out of the casing 4, whereby its maintenance is facilitated.

Figure 4:
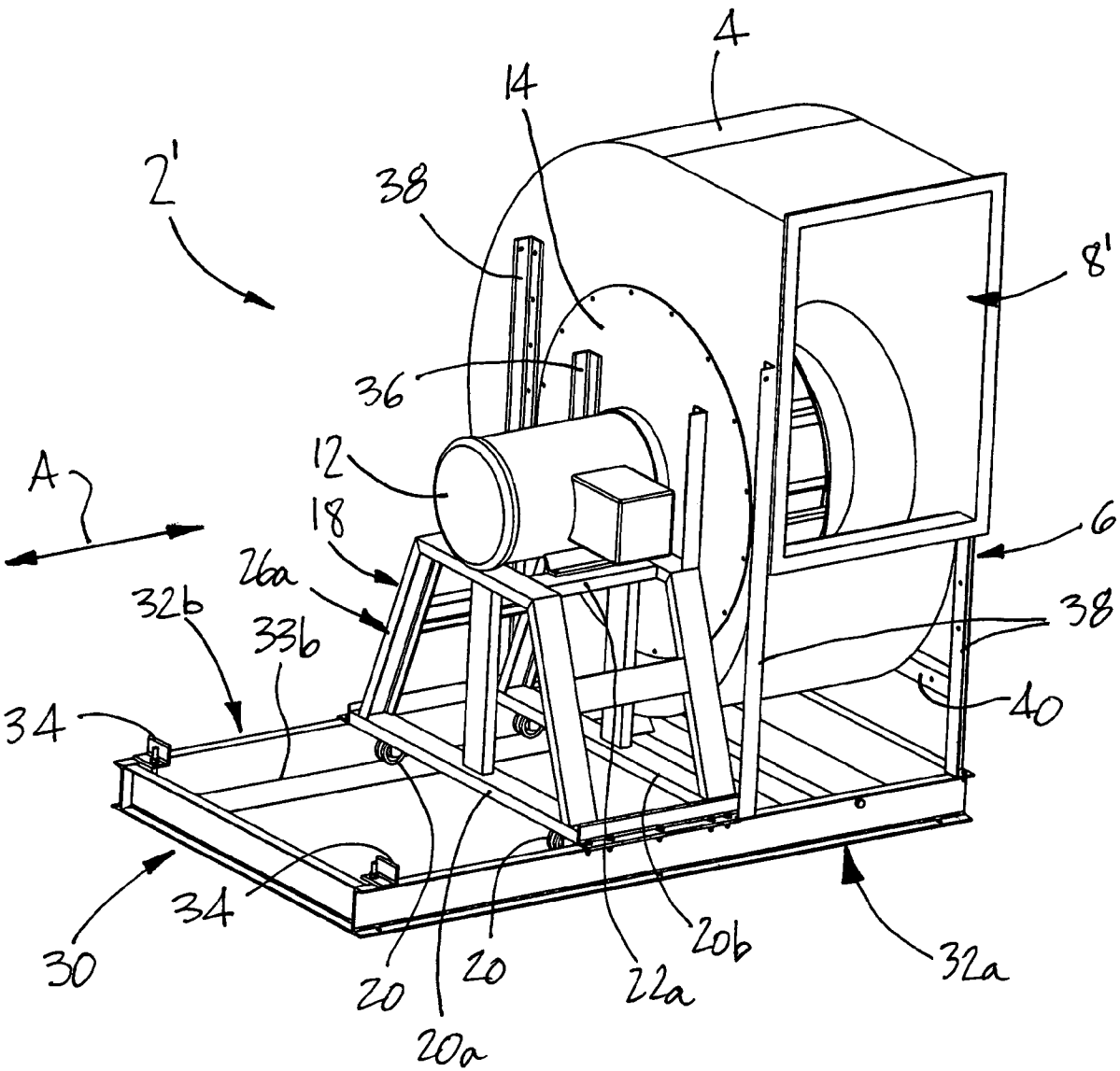
FIG. 4 is a perspective view of another fan assembly in accordance with a preferred embodiment of the present invention, in an operating position, the fan assembly having a laterally positioned outlet.

It is contemplated to provide a locking mechanism on the carriage 18, or on the structure 30, so as to lock the carriage 18 in position on the structure 30. Although the fan assembly 2 has been illustrated and described as a centrifugal fan, it is contemplated to provide axial fan assemblies or any other such fan assembly with the above-described maintenance configuration. For instance, as shown in FIG. 4, a fan assembly also in accordance with the present invention is generally shown at 2'. The fan assembly 2' of FIG. 4 is essentially similar to the fan assembly 2 of FIG. 1, save that the fan assembly 2' (FIG. 4) has a laterally facing outlet 8' as opposed to the top outlet 8 of the fan assembly 2 of FIG. 1. Accordingly, for simplicity purposes, the same reference numerals have been shared by the fan assemblies 2 of FIGS. 1 and 2' of FIG. 4, save for the outlet 8 and 8'.

It is pointed out that the weight of the rotor 10 and the motor 12 is supported by the carriage 18, such that the casing 4 does not bear any of the weight of the rotor 10. Moreover, the rotor 10 and motor 12 are fully supported throughout the displacement of the carriage 18 from the operating position to the maintenance position, whereby no manpower is required to support the weight of the rotor 10 and motor 12.

In order to return the rotor 10 in the casing 4 for operation of the fan assembly 2, the carriage 18 is translated toward the casing 4. When the wall portion 14 abuts against the casing 4, and covers the opening through which the rotor 10 has entered the casing 4, the wall portion 14 is secured to the casing 4. In the illustrated embodiment, this is achieved by using the fasteners to fix the wall portion 14 in position to the casing 4.

It is contemplated to retrofit existing fan assemblies with tracks and a carriage to facilitate maintenance of such fan assemblies. In such cases, it may be required to make an opening in the casing, through which the rotor will pass when removed from the casing.

While the invention has been described in connection with specific embodiments thereof, it will be understood that it is capable of further modifications and this application is intended to cover any variations, uses, or adaptations of the invention following, in general, the principles of the invention and including such departures from the present disclosure as come within known or customary practice within the art to which the invention pertains and as may be applied to the essential features hereinbefore set forth, and as follows in the scope of the appended claims.

I claim:

1. A fan assembly comprising:

a casing having an inlet and an outlet for fluid circulation through the casing, and a closeable opening to allow access to an interior of the casing;

a rotor to induce fluid circulation in the casing;

a motor connected to the rotor so as to actuate the rotor;

a track; and a carriage supporting the motor and the rotor, the carriage being operatively mounted to the track so as to be displaceable between an operating position of the fan assembly, in which the rotor is positioned in the casing for inducing fluid circulation in the casing, and a maintenance position of the fan assembly, in which the rotor is out of the casing for maintenance, the carriage having wheels so as to roll on the tracks between the operating position and the maintenance position of the fan assembly;

wherein the rotor is displaced between the operating position and the maintenance position through the closeabble opening.

2. The fan assembly according to claim 1, further comprising a wall portion mounted to the carriage so as to cover the closeable opening in the operating position of the fan assembly, and displaceable with the carriage so as to expose the closeable opening in the maintenance position of the fan assembly.

3. The fan assembly according to claim 2, wherein the rotor and the motor are on opposed sides of the wall portion.

4. The fan assembly according to claim 1, comprising two of the track, with the carriage being supported on opposed sides by the tracks.

5. The fan assembly according to claim 1, wherein the track is a member of a structure supporting the casing, whereby the fan assembly is an integral unit formed on the structure.

6. The fan assembly according to claim 1, further comprising a stop on the track, so as to limit the displacement of the carriage away from the casing to the maintenance position.

7. A system for supporting a motor and rotor of a fan assembly, comprising:

a track adapted to be positioned adjacent to a closeable opening in a casing of the fan assembly; and a carriage adapted to support the motor and the rotor, the carriage being operatively mounted to the track so as to be displaceable between an operating position of the fan assembly, in which the rotor is in the casing so as to induce fluid circulation in the casing, and a maintenance position of the fan assembly, in which the rotor is out of the casing to allow access to an interior of the casing through the closeable opening, the rotor passing through the closeable opening when the carriage is displaced between the operating position and the maintenance position, the carriage having wheels so as to roll on the tracks between the operating position and the maintenance position of the fan assembly.

8. The system according to claim 7, further comprising a wall portion secured to the carriage so as to be displaceable with the carriage, the wall portion being positioned on the carriage so as to cover the closeable opening in the casing when the carriage is in the operating position.

9. The system according to claim 7, further comprising a stop on the track, so as to limit the displacement of the carriage away from the casing to the maintenance position.

10. A fan assembly comprising:

a casing having an inlet and an outlet for fluid circulation through the casing, and a closeable opening to allow access to an interior of the casing;

a rotor to induce fluid circulation in the casing;

a motor connected to the rotor so as to actuate the rotor;

a track;

a carriage supporting the motor and the rotor, the carriage being operatively mounted to the track so as to be displaceable between an operating position of the fan assembly, in which the rotor is positioned in the casing for inducing fluid circulation in the casing, and a maintenance position of the an assembly, in which the rotor is out of the casing for maintenance;

a stop on the track, so as to limit the displacement of the carriage away from the casing to the maintenance position wherein the rotor is displaced between the operating position and the maintenance position through the closeable opening.

11. The fan assembly according to claim 10, further comprising a wall portion mounted to the carriage so as to cover the closeable opening in the operating position of the fan assembly, and displaceable with the carriage so as to expose the closeable opening in the maintenance position of the fan assembly.

12. The fan assembly according to claim 10, wherein the rotor and the motor are on opposed sides of the wall portion.

13. The fan assembly according to claim 10, comprising two of the track, with the carriage being supported on opposed sides by the tracks.

14. The fan assembly according to claim 10, wherein the track is a member of a structure supporting the casing, whereby the fan assembly is an integral unit formed on the structure.

15. A system for supporting a motor and rotor of a fan assembly, comprising:

a track adapted to be positioned adjacent to a closeable opening in a casing of the fan assembly;

a carriage adapted to support the motor and the rotor, the carriage being operatively mounted to the track so as to be displaceable between an operating position of the fan assembly, in which the rotor is in the casing so as to induce fluid circulation in the casing, and a maintenance position of the fan assembly, in which the rotor is out of the casing to allow access to an interior of the casing through the closeable opening, the rotor passing through the closeable opening when the carriage is displaced between the operating position and the maintenance position; and a stop on the track, so as to limit the displacement of the carriage away from the casing to the maintenance position.

16. The system according to claim 15, further comprising a wall portion secured to the carriage so as to be displaceable with the carriage, the wall portion being positioned on the carriage so as to cover the closeable opening in the casing when the carriage is in the operating position.

* * * * *